United States Patent [19]

Tann

[11] 4,176,264

[45] Nov. 27, 1979

[54] LINEAR PROGRAMMER FOR AN ACTUATOR

[75] Inventor: David Tann, Detroit, Mich.

[73] Assignee: Electro-Mechanical Products, Detroit, Mich.

[21] Appl. No.: 897,100

[22] Filed: Apr. 17, 1978

Related U.S. Application Data

[63] Continuation of Ser. No. 711,433, Aug. 4, 1976, abandoned.

[51] Int. Cl.[2] ..... H01H 35/38

[52] U.S. Cl. ..... 200/82 E; 200/47; 335/207

[58] Field of Search ..... 200/83 L, 82 E, 81.9 M, 200/81.4, 81.5, 47, 61.45 M, 61.5; 192/142 R, 143; 335/205, 206, 207

[56] References Cited

U.S. PATENT DOCUMENTS

| | | | |
|---|---|---|---|
| 3,105,551 | 10/1963 | Ehlert | 335/207 |
| 3,444,493 | 5/1969 | Nieuwhof | 335/206 |
| 3,510,607 | 5/1970 | Breed | 200/81.4 |
| 3,639,868 | 2/1972 | Gasper | 200/81.9 M |
| 3,646,293 | 2/1972 | Howard | 200/84 C |
| 4,071,725 | 1/1978 | Smith | 200/82 E |

*Primary Examiner*—Gerald P. Tolin
*Attorney, Agent, or Firm*—Krass & Young

[57] ABSTRACT

A control device includes a magnetically actuated responder and an actuator. The responder is fixed to a relatively stationary portion of an apparatus and the actuator is fixed to a portion of the apparatus which is movable relative to the fixed portion. The fixed portion includes a housing for constraining the second, movable portion to linear movement. The actuator is located so that its outer surface is recessed into the surface of the movable portion flush with the surface of the movable portion of the apparatus thus providing an actuator for the responder which does not interfere with the movement of the movable portion. An alternate embodiment contemplates the use of a plurality of flush-mounted actuators axially spaced along the movable member with each actuator occupying only a portion of the circumference of the movable portion. A plurality of corresponding responders are located about the circumference of the movable portion for actuation by the actuators in response to the movable portion of the apparatus reaching predetermined positions relative to the fixed portion of the apparatus.

5 Claims, 6 Drawing Figures

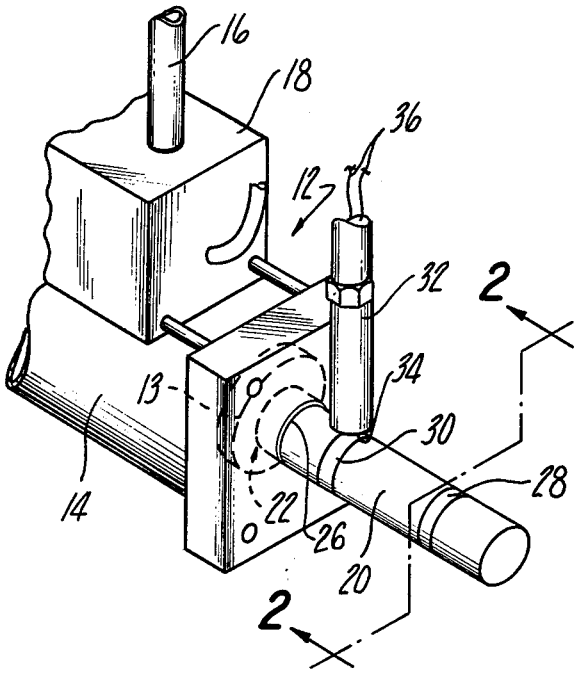
Fig-1
Fig-2
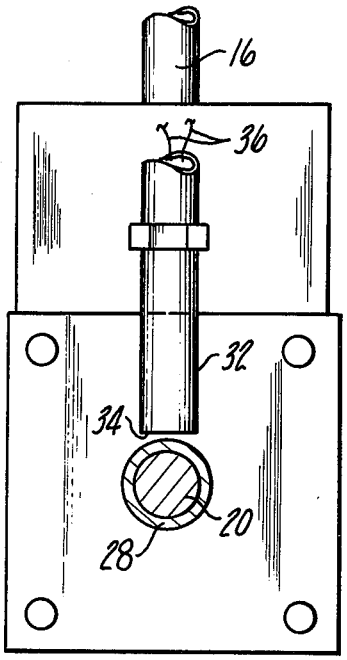
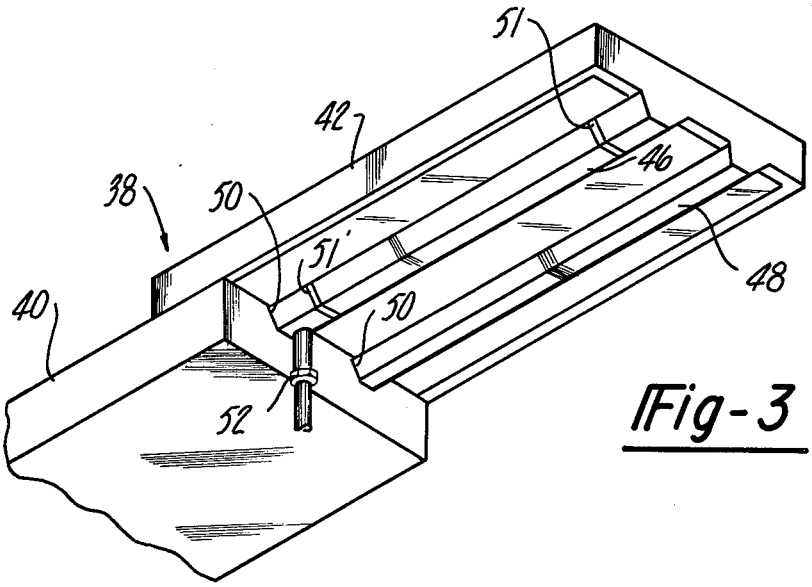
Fig-3

LINEAR PROGRAMMER FOR AN ACTUATOR

This is a continuation of application Ser. No. 711,433, now abandoned filed Aug. 4, 1976.

BACKGROUND OF THE INVENTION (1) Field of the Invention

This invention relates to an improved machinery control device. More particularly this invention relates to machinery where a movable member is utilized to control itself or mechanisms that make up the machinery. Still more particularly, this invention relates to a magnetically actuated control device wherein an actuator for a responder permits free operation of the device as well as operation in confined quarters.

(2) Description of the Prior Art

Electrically controlled machines such as machine tools, assembly and forming machines, hoists, and a large variety of mechanical devices, commonly use "limit" switches to sense the position of a movable element and provide the necessary control. The control may be provided through the operation of a valve, a solenoid or relay, or the direct control of the machinery itself. In most applications a responder is mounted on the machine or apparatus for which the control is being provided, and an actuator is positioned adjacent the responder for selective operation of the responder. Ordinarily, the actuator is mounted on the movable component of the machinery, and the responder remains relatively stationary. The responder is actuated, for control purposes, as the actuator draws near the responder.

In complex electrically controlled machinery, such as automatic or semiautomatic equipment, a large number of actuators and responders may be required. In such installations, it is not desirable to mount a large number of switches upon the apparatus with the actuators or responders in exposed locations due to the likelihood of accidental damage to either or both switch elements.

Limit switches of various types are known, such as the mechanically actuated switch shown in U.S. Pat. No. 3,192,349. Mechanically actuated switches, due to the contact between the actuator and the responder necessary for operation, are unsuitable in certain applications. Magnetically actuated switches are known in the art, such as disclosed in U.S. Pat. No. 3,172,976, assigned to the assignee of the present invention. Magnetically actuated switches have the advantage of being actuable without requiring physical contact between the actuator and the responder.

If the switches known in the prior art must be used where space is an important consideration, difficulties arise. When machinery includes a reciprocating member which must pass through a sliding seal, as in a hydraulic power piston, actuators of the prior art must often be mounted on an extension affixed to the reciprocating member. Mounting of this nature is often required if control of functions corresponding to extended linear positions of the reaprocating member is desired. Often, the actuators and responders, of necessity, must be mounted at some distance from the main portion of the device, perhaps on an extension of a piston rod. To achieve operating stability, an outboard bearing for the piston rod extension is often required. An outboard bearing requires valuable, useful space and is vulnerable to contamination and abuse due to its separation from the main body of the machinery.

SUMMARY OF THE INVENTION

The present invention utilizes a magnetically actuated control switch (which includes a magnetically actuated responder and a magnetic actuator) for selectively energizing and deenergizing an electric circuit. At least a portion of the responder is fixed with respect to a first member. At least a portion of the actuator is fixed with respect to a second member which is capable of movement relative to the first member. The actuator is recessed so that its surface is flush with that of the second member in order that actuation of the switch may be carried out without interference with the relative movement between the first and second members. The actuator and responder are positioned so that switch actuation occurs when the first and second members reach a predetermined relative position.

An object of the present invention is to provide an improved switch control device of the above-mentioned type which is usable in areas with little available space.

Another object of the invention is to provide an improved control device for sensing linear movement of the above-mentioned type which is reliable and efficient in operation, economical of manufacture, and trouble-free in operation.

Further objects and advantages of the present invention will become apparent and the exact nature of the invention will be clearly understood when the following description is considered in conjunction with the drawings.

BRIEF DESCRIPTION OF THE DRAWINGS

FIG. 1 is a fragmentary perspective view of a power piston embodying the present invention.

FIG. 2 is a sectional end view, along the line 2—2 of the embodiment of FIG. 1.

FIG. 3 is a perspective view of the underside of a machine embodying the subject invention.

DESCRIPTION OF THE PREFERRED EMBODIMENTS

Figure 4:
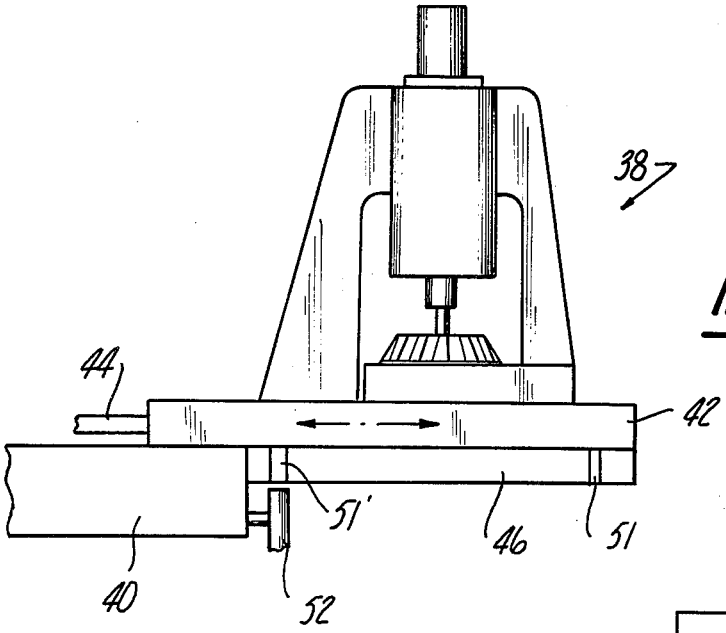
FIG. 4 is a front elevation view of the embodiment of FIG. 3.

FIG. 1 illustrates a fluid operated power cylinder 12. A power piston 13 is enclosed within the cylinder wall 14 and reciprocates in contact with fluid which communicates with the cylinder through a conduit 16 and a hydraulic switching apparatus 18.

A rod 20 is connected to the power piston 13 internally of the power cylinder 12 and exits from the power cylinder through an opening 22 in an end face 24. The end face 24 includes a bearing surface for the rod 20. In order to prevent the fluid which provides the motive force for the power piston 13 from escaping from the power cylinder 12, a sliding seal 26 permits reciprocation of the rod 20 while preventing any fluid leakage.

A band of magnetic material 28 is located about the circumference of the rod 20. The band 28 encircles the rod 20 and is recessed into the surface of the rod 20 such that the band's most radially outward portion is flush with the circumference of the rod. As may be best seen in FIG. 2, the band 28 has a radial extent which is only a portion of the total radial thickness of the rod 20.

A second band of magnetic material 30, with its radially outermost portion flush with the circumference of the rod 20, appears about the rod. The magnetic band 30 is spaced axially inwardly along the rod 20, nearer the basal end of the rod compared with the band 28 which is near the rod's distal end.

A magnetically actuated responder 32 is fixed with respect to the power cylinder 12. The responder 32 may be of any type which is actuated by the proximity of magnetic material, such as the responder disclosed in U.S. Pat. No. 3,172,976, mentioned above. The operating face 34 of the responder 32 is located with respect to the rod 20 in a manner that the bands 28 and 30 act as actuators when either of them is aligned with the responder's operating face.

Conductors 36 supply any signal generated by the responder 32 to the switching arrangement 18 for operation of the power cylinder 12 as described below.

When the piston 13 of the power cylinder 12 is in a position such that the rod 20 is in the fully extended position as illustrated in FIG. 1, the actuator band 30 is in position to actuate the responder 32. In response the actuator 32 produces a signal which is conducted, via the conductors 36, to the switching arrangement 18. The signal received causes the switching arrangement 18 to react in a manner to direct the fluid to exert a force on the piston 13 which urges the piston to the left thereby retracting the rod 20 within the power cylinder 12.

As the piston moves, it retracts the rod 20 until the rod is in a position wherein the actuator band 28 is aligned with and actuates the responder 32. The responder 32, upon being actuated, produces another signal. This latter signal is supplied to the switching arrangement 18 which, in the conventional manner, causes the fluid to impinge on the opposite side of the piston thereby urging the piston in the opposite direction. If an automatically reciprocating piston is not desired, the latter signal may operate to place the switching arrangement in a neutral mode. In the event that this neutral mode operation is desired, the actuation of a separate switch would be necessary before the piston 13 and the rod 20 would again assume the configuration shown in FIG. 1.

In the embodiment shown in FIG. 1, the actuator bands 28 and 30 are able to pass through the sliding seal 26 due to the coextensive nature of the mounting of the bands with respect to the rod 20. It is not inconceivable that the responder 32 could be mounted in a manner to protrude through the walls 14. A mounting of that nature would permit the rod 20, in its fully retracted position, to have its end face coextensive with the end face of the cylinder 12 thus permitting operation of the power cylinder 12 in very confined quarters. Provision might easily be made for varying the position of the responder relative to the cylinder to provide an adjustable actuation point.

Naturally, if the rod 20 were constructed of a magnetic material the actuation bands 28 and 30, which serve as actuators for the responder 32, would be constructed of a different non-magnetic material. The responder would then produce a signal when a non-magnetic actuator was aligned therewith.

FIG. 3 shows the underside of a machine 38 which might be, for example, a milling machine. The machine includes a base portion 40 and a work-piece-holding bed 42 mounted on the base. The bed 42 is reciprocated on the base 40 by a reciprocating power source (not shown) through the rod 44, as best seen in FIG. 4.

FIG. 3 best illustrates the projections 46 and 48 which ensure that the bed 42 reciprocates in accurate relationship with the base 40 by being seated in corresponding ways 50 formed within the base. A recess formed into the surface of the projection 46 includes a band of magnetic actuator material 51 about its circumference mounted in a manner that its periphery is with the periphery of the projection 46. Spaced somewhat inwardly along the projection 46 is another band of magnetic actuator material 51′ which is likewise mounted so as to be flush with the projection. A magnetic proximity responder 52 is fixedly secured with respect to the base 40 and is actuated by the magnetic actuator bands 51 and 51′ in a manner similar to that of the embodiment illustrated in FIGS. 1 and 2 discussed above. Naturally, should additional relative-position signals be desired, these could be obtained by providing additional magnetic actuators along the projection 46. Actuator bands 51 and 51′, as well as any additional actuators, are out of the way of any debris resulting from operation of the machine 38. The method of mounting of the actuators 51 and 51′ also permits a shorter bed thus saving space while permitting mounting the responder 52 in a protected location, close to the base.

Figure 5:
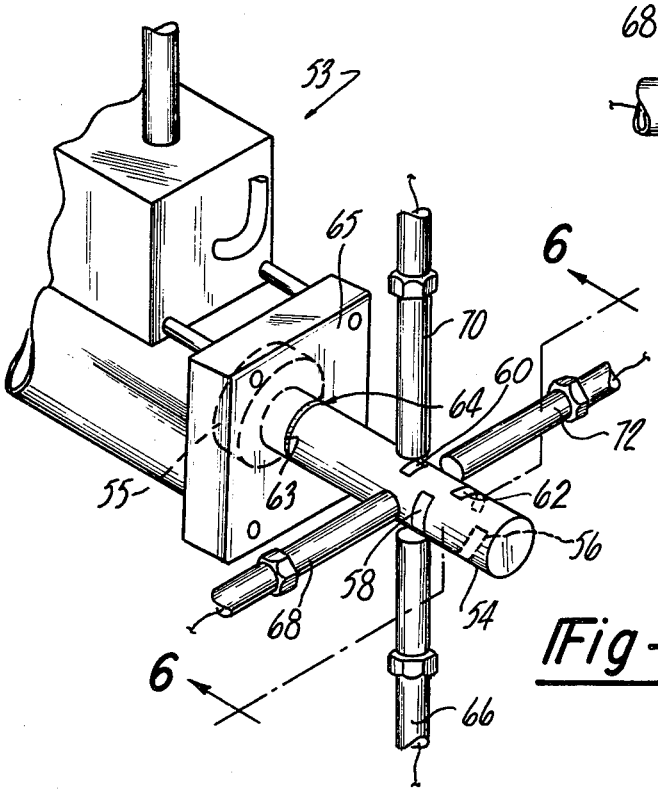
FIG. 5 is a fragmentary perspective view of a power piston including an alternate embodiment of the subject invention.

FIG. 5 illustrates an alternate embodiment of a fluid operated power cylinder 53 which is similar to the fluid operated cylinder 12 illustrated in FIG. 1. The rod 54 is fixed to a power piston 55 within the power cylinder 53. The rod 54 has a number of arcuate, magnetic actuators 56, 58, 60, and 62, recessed so that the outer portions of their respective peripheries are flush with the peripheral surface of the rod 54. Each of the arcuate actuators, 56, 58, 60, and 62 has an axial extent upon the rod 20 which is limited. The actuators each occupy approximately one-quarter of the circumference of the rod 54.

Figure 6:
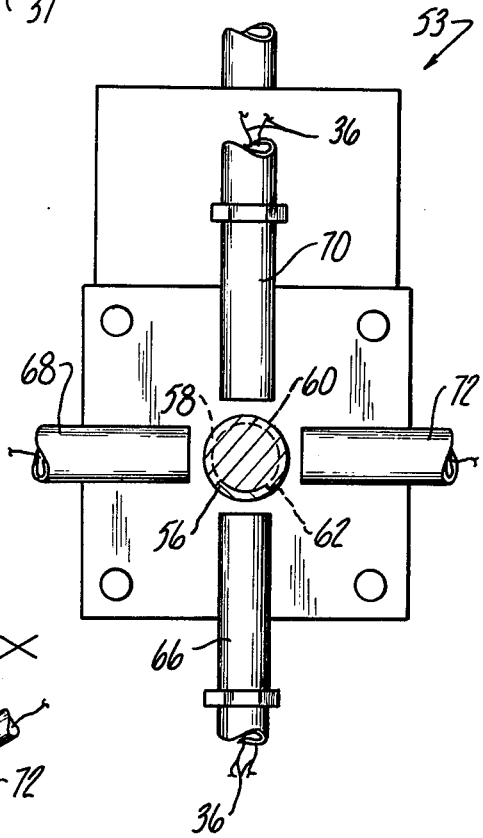
FIG. 6 is a sectional end view, along the line 6—6, of the embodiment of FIG. 5.

Spaced axially inwardly from the arcuate actuator 56 is the arcuate actuator 58. Actuator 58 is made of magnetic material and is of approximately the same or similar extent as actuator 56 but occupys a different angular position on the rod 54 as well as a different axial location. FIG. 6 best illustrates the partial circumferential and radial extent of the actuator 58. The actuators 60 and 62 are located on the rod 54 at axial and angular positions which vary from the positions of actuators 56 and 58.

The cylinder 53 illustrated in FIGS. 5 and 6 has a sliding seal 63 about the opening 64 in its end face 65 through which the rod 54 slides. Located near this last-mentioned end face, in fixed relation to the power cylinder, are four magnetically actuated responders 66, 68, 70, and 72, located for actuation by the arcuate magnetic actuators 56, 58, 60, and 62 respectively.

As the rod 54 is moved either outward or inward under the action of the fluid within the power cylinder 53, the magnetically actuated responders 66, 68, 70, and 72, will be actuated in turn when they align with the corresponding arcuate magnetic actuators 56, 58, 60 and 62. The signals produced by the actuation of the aforementioned switches may be used to initiate any of a variety of functions which depend upon the linear extension or position of the rod 54 or the piston to which it is attached.

The most basal actuator 62 and the most distal actuator 56 could be used to provide signals to initiate reciprocation with the intermediate actuators initiating other, linear-position-related, functions. Also, the number of bands of magnetic actuators need not be limited to four and the corresponding magnetic proximity responders likewise need not be limited. Of course, the rod 20 may be made of magnetic material in which instance the arcurate actuators would be made of nonmagnetic material.

While the embodiments disclosed herein are preferred embodiments, it is intended that the invention not be limited to what has been specifically disclosed. It is recognized that various modifications may be apparent to those skilled in the art without departing from the spirit and scope of the invention.

I claim:

1. A linear programmer arrangement in combination with an actuator, said actuator including:

a movable actuator member;

means supporting said actuator member for linear movement, including a housing and bearing means slidably receiving a portion of said actuator member for movement into and out of containment by said housing;

at least one programming insert mounted within a recess formed in said portion of said actuator member and configured to be flush with the surface thereof so as to be able to be slidably received by said bearing means, said programming insert being formed from a different material than said movable actuator member;

responder means mounted to be fixed with respect to said movable actuator member and having a portion adjacent said actuator portion in line with said actuator portion and located to come into juxtaposition with said programming insert during said movement of said actuator member, said responder means including means generating an electrical signal in response to said programming insert coming into juxtaposition with said responder portion, whereby said electrical signal is generated whenever said movable actuator member is in a predetermined relationship with said housing member corresponding to the position of said programming insert, wherein said movable actuator member comprises a piston head and a piston shaft slidably supported in said bearing means and wherein said programming insert is recessed into the surface of said piston shaft and having an outer surface thereof flush with respect to the surface of said shaft circumference, whereby said programming insert is moved through said bearing means.

2. The linear programmer arrangement according to claim 1 wherein said programming insert is constructed of a nonmagnetic material and wherein said movable actuator member is constructed of a magnetic material, wherein said responder means includes magnetic switch means responsive to said responder portion moving into juxtaposition with said programming insert to generate said electrical signal by detecting the presence of said nonmagnetic material of which said programming insert is formed.

3. The linear programmer arrangement according to claim 1 wherein said actuator member comprises a piston and cylinder arrangement wherein said cylinder comprises said housing member and wherein said piston is slidably mounted in said cylinder and wherein said shaft is mounted to said piston for movement into and out of containment in said cylinder.

4. The linear programmer arrangement according to claim 3 wherein said piston and cylinder further includes a seal means carried by said housing and surrounding said shaft in sealing engagement therewith as said shaft is moved into and out of containment within said cylinder and wherein said portion of said shaft wherein said programming insert is mounted passes through said sealing means.

5. The linear programmer arrangement according to claim 3 further including a plurality of said programming inserts mounted recessed into the surface of said shaft to be flush therein and further including a plurality of said responder means each mounted fixed with respect to said shaft and in position whereat respective portions thereof move into juxtaposition with respect to said programming inserts during said sliding movement of said shaft.

* * * * *